US006543160B2

(12) United States Patent
Price

(10) Patent No.: US 6,543,160 B2
(45) Date of Patent: Apr. 8, 2003

(54) ATHLETIC SHOE ATTACHMENT

(75) Inventor: Shawn Price, Reno, NV (US)

(73) Assignee: Price Advanced Innovations, Inc., Reno, NV (US)

( * ) Notice: Subject to any disclaimer, the term of this patent is extended or adjusted under 35 U.S.C. 154(b) by 0 days.

(21) Appl. No.: 09/827,041

(22) Filed: Apr. 5, 2001

(65) Prior Publication Data

US 2002/0144439 A1 Oct. 10, 2002

(51) Int. Cl.[7] ..... A43C 15/02
(52) U.S. Cl. ..... 36/127; 36/132
(58) Field of Search ..... 36/127, 144, 132, 36/136

(56) References Cited

U.S. PATENT DOCUMENTS

| | | | | |
|---|---|---|---|---|
| 1,025,087 | A | * | 4/1912 | Hart |
| 2,784,503 | A | * | 3/1957 | Anderson |
| 3,195,246 | A | * | 7/1965 | Ueda |
| 3,218,734 | A | | 11/1965 | O'Brien |
| 3,328,901 | A | * | 7/1967 | Strickland |
| 3,964,180 | A | | 6/1976 | Cortese |
| 4,167,071 | A | | 9/1979 | Koransky |
| 4,407,079 | A | | 10/1983 | Chiroff |
| 4,704,809 | A | | 11/1987 | Ballard |
| 4,875,683 | A | | 10/1989 | Wellman et al. |
| 5,505,012 | A | * | 4/1996 | Walker |
| 5,906,059 | A | * | 5/1999 | Singer et al. |
| 6,182,379 | B1 | | 2/2001 | Savage |

FOREIGN PATENT DOCUMENTS

| | | | |
|---|---|---|---|
| FR | 2644989 | * | 10/1990 |

* cited by examiner

*Primary Examiner*—Ted Kavanaugh
(74) *Attorney, Agent, or Firm*—Reising, Ethington, Barnes, Kisselle, Learman & McCulloch, P.C.

(57) ABSTRACT

An athletic shoe attachment comprises a wedge-shaped shim adapted to be interposed between the bottom of a shoe and a ground engageable traction member. Any selected traction member may be removed and replaced by a shim, and the removed traction member may be mounted on the shim in ground engageable position.

9 Claims, 1 Drawing Sheet

ATHLETIC SHOE ATTACHMENT

ATHLETIC SHOE ATTACHMENT

This invention relates to an attachment for an athletic shoe, and particularly a golf shoe, for the purpose of training or assisting a person in controlling weight shifts during the execution of a golf stroke.

BACKGROUND OF THE INVENTION

Some golfers and golf instructors believe the manner in which a player controls the shifting of his weight during the back swing and fore swing of a golf club is a key consideration in executing all golf strokes other than a putt. Some of such persons espouse the theory that the foot farther from the target should be so positioned that the player's weight is concentrated on that edge of his foot which is closer to the target. One way in which this theory can be put to practice is for the player's foot to be elevated at that edge of the latter which is farther from the target. Thus, if the player is right handed, then according to this theory the outside or right edge of his right shoe should be raised during the execution of the golf stroke.

Several aids have been proposed heretofore for the purpose of assisting a player to control his weight shift during the execution of a golf stroke. Not all of them have been successful, however, for a variety of reasons. Among these are cumbersomeness, the inability to enable the player to use or forego use of the aid, and the inability to retrofit his existing shoes with the aid.

For several years traditional, single point golf spikes have been criticized as being damaging to the surfaces of putting greens and, in many cases, have been banned from use on golf courses. The traditional single point metal spikes, in many instances, have been replaced by yieldable traction devices usually comprising a circular body provided at its rim with a plurality of circumferentially spaced, ground engageable projections. Each of these traction devices conventionally is equipped with a threaded coupling which may be accommodated in a correspondingly threaded socket formed in the shoe bottom, at both the sole and heel portions thereof. As a result of this construction any of the traction devices is removable from its associated socket for replacement should the need arise.

A principal object of the invention is to provide means for assisting a player in shifting his weight theoretically correctly during the execution of a golf stroke and which is not subject to the disadvantages of previously known devices for the same or similar purpose.

SUMMARY OF THE INVENTION

Apparatus constructed in accordance with the invention comprises a shim which is adapted to be interposed between the bottom of a shoe and a traction member with which the shoe normally is provided. Conventional golf shoes have threaded sockets in the sole and heel portions of the shoe bottom. Traction members or cleats have threaded coupling projections which enable such members removably to be accommodated in the sockets. The traction members have ground engageable projections usually comprising circumferentially spaced lugs which provide traction for the shoe.

A shim according to the invention has a threaded coupling projecting from one face thereof for accommodation in a threaded socket of the shoe and, on its opposite face, a threaded socket corresponding to a threaded socket of the shoe. The socket of the shim thus is enabled to accommodate the threaded coupling projection of the traction member following its separation from the shoe and the shim may be interposed between the traction member and the shoe bottom, thereby positioning the traction member at a greater distance from the shoe bottom than it otherwise would be and elevating that portion of the shoe adjacent the shimmed traction member.

It is proposed to interpose a shim of the kind described between some, but not all, of the traction members with which the golf shoe originally is equipped. For example, two or three of the traction members adjacent one edge of the shoe may be shimmed, thereby causing that edge of the shoe to be positioned at a higher level above ground than the opposite side of the shoe bottom. It thus is possible for a player to retain all of the traction devices with which his shoes originally were equipped and to obtain the benefit of proper weight transfer during the execution of a stroke.

Since the coupling projection and the socket of the shim correspond to the coupling projections of the traction member and the sockets in the shoe bottom, the shim may be substituted for any one of the traction members and the latter may be coupled to the shim so that the shim occupies a portion between the shoe bottom and the traction member.

THE DRAWINGS

DETAILED DESCRIPTION

Figure 1:
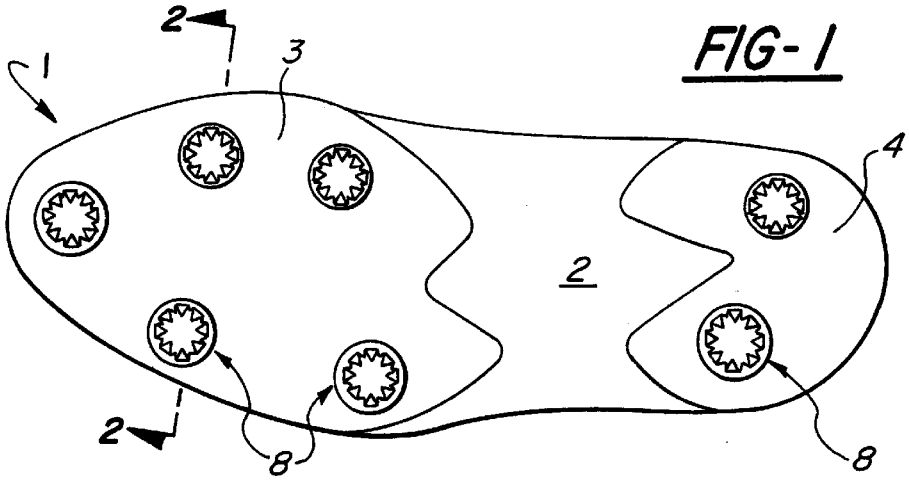
FIG. 1 is a bottom plan view of a golf shoe fitted with traction memos and some shims according to the invention.

An attachment constructed in accordance with the invention is adapted for use with a conventional golf shoe 1 having a bottom 2 comprising a sole 3 and a heel 4, the surfaces of which are adapted to confront the ground 5. The shoe shown in FIG. 1 is one that is adapted to fit the right foot of a person, but it will be understood that the description to follow is equally applicable to a left shoe.

The shoe bottom 2 is provided with a plurality of uniform, internally threaded securing or coupling sockets 6 and each such socket is adapted to accommodate a correspondingly threaded coupling projection 7 carried by and extending from one side of a traction member 8 having a circular body 9 provided with circumferentially spaced, ground engageable lugs 10. The traction member 8 may be constituted by any one of a number of currently available, somewhat deformable, plastic or rubbery units which provide a golfer with adequate traction, but are not as harmful to a putting green surface as are the conventional single point metal spikes.

Each traction member 8 conventionally includes diametrally spaced openings (not shown) for the accommodation of a spanner wrench (not shown) for facilitating securing and removing the traction member 8 to and from the bottom of the shoe 1.

In the embodiment shown in FIG. 1 there is an array of seven spaced apart traction members 8, five of which are applied to the sole portion 3 and two of which are applied to the heel portion 4. The number and arrangement of the traction members may correspond to that shown, or may be different according to the size of the shoe and the preference of its manufacturer.

Figure 3:
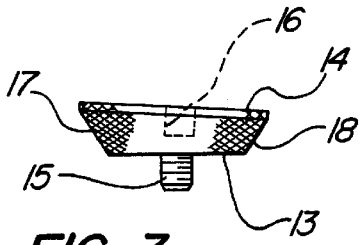
FIG. 3 is a side elevational view, on an enlarged scale, of a shim.
Figure 4:
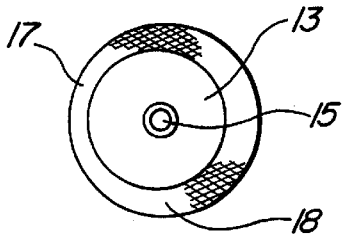
FIG. 4 is a plan view of the shim shown in FIG. 3.

At selected sites at the bottom of the shoe a shim 11 is interposed between the traction member and the bottom surface of the shoe. The shim is best shown in FIGS. 3 and 4 and comprises a circular body 12 having substantially planar, opposite faces 13 and 14, the surface 14 being inclined relative to the surface 13. The inclination of the surface 14 results in the shim's having a wedge-like configuration tapering diametrally from one edge to the other.

Extending from the surface 13 and perpendicular thereto is a threaded coupling projection 15. Extending into the body 12 from and perpendicular to the surface 14 is a threaded coupling or securing socket 16. The projection 15 and the socket 16 correspond in size to the projection 7 and the socket 6, respectively, referred to earlier so as to be interchangeable with the latter. Preferably, the body 12 has a side wall 17 of truncated conical configuration which tapers longitudinally in the direction of the surface 13. The side wall 17 may be knurled or milled as at 18 to facilitate rotation of the body.

Figure 2:
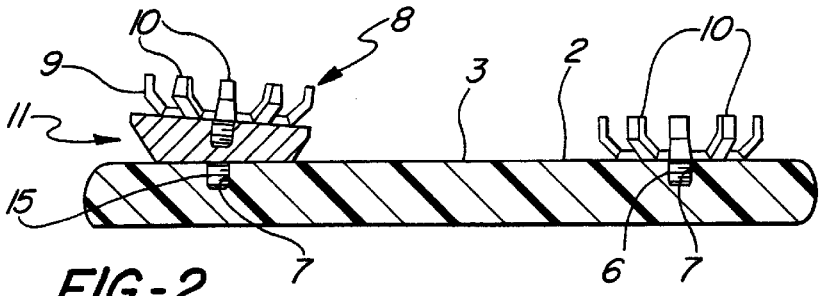
FIG. 2 is a sectional view, on an enlarged scale, and taken along the line 2—2 of FIG. 1.
Figure 5:
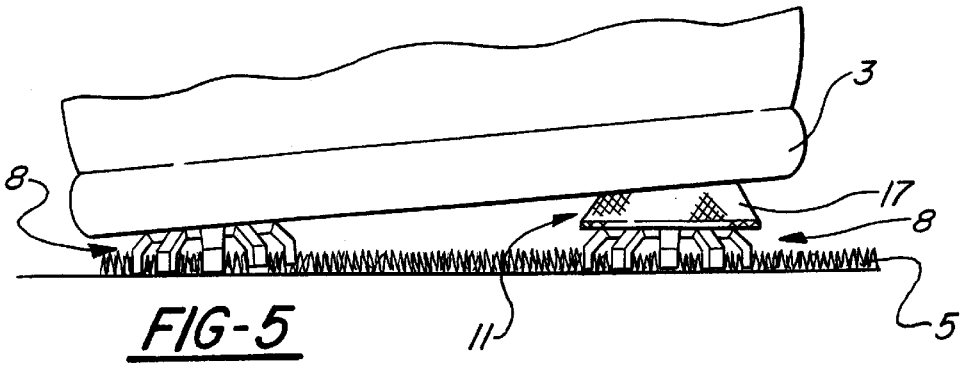
FIG. 5 is a transverse sectional view similar to FIG. 2, but illustrating the shoe in the position it occupies when worn by a golfer.

To condition the disclosed shoe for use, the player may remove selected ones of the traction members 8, secure each of the removed traction members to a shim 11 and then secure the shim to the shoe by means of the socket 6 and the projection 15 so that the shim is substituted for the removed traction member and occupies a position between the shoe bottom and the removed traction member, as is shown in FIGS. 2 and 5. It is contemplated that the traction members which will be shimmed are those along that side of the player's shoe which is farther from the target or intended flight of the golf ball during the execution of a golf stroke. Thus, if the shoe is a right shoe and the player is right-handed, the shimmed traction members may be those along the side of the sole portion. If desired, the forwardmost traction member also may be shimned. In addition, it may be desirable to shim the traction member or members that lie along the right side of the shoe heel portion 4.

Preferably, the diameter of the surface 14 of the shim on which the traction device 8 seats is sufficient to provide stable support for the body 9 and the lugs 10 so as to avoid undue stressing of the latter.

The opposite surface 13 of the shim is of sufficient area to provide a stable seat against and substantially parallel to the bottom of the shoe. However, since the bottom surfaces of some golf shoes have ridges, abutments, or other uneven areas which would prevent the shim from seating flush on the bottom surface, the shim is tapered longitudinally, i.e., in the direction of the shoe bottom, thereby reducing the area of the surface 13.

Not all shims are required to be wedge-like. In this event the shim may comprise a disk of uniform thickness. However, by inclining that surface of the shim on which a traction member seats, the wedge configuration thus formed enables the traction member that is secured to the shim to be oriented to the ground in substantially the same manner as those traction members that are not shimmed. This avoids uneven wearing of the lugs 10 of the shimmed traction members and minimizes the possibility of damaging the surface of a putting green.

Not all shims need be of the same thickness. Instead, some shims may be thicker than others, thereby enabling different players to select the height to which the outside edges of their shoes may be raised, or enabling different thickness shims to be used on the same shoe and provide a ramp-like effect in elevating the bottom of the shoe.

When a player fitted with golf shoes having shimmed traction members at the bottom of the shoe addresses a golf ball at the beginning of a stroke, the presence of the shims will cause the shimmed side of the bottom of his shoe to occupy a level above the ground higher than that of the opposite side of his shoe. This will cause the weight of the golfer to be concentrated on the ball or inside edge of the foot on which the shimmed shoe is worn, thereby enabling the golfer to minimize the tendency to roll his foot outwardly or sway during the execution of a stroke. Repeated use of the shims will help train the player to control his weight shift even though the shims may be removed from the shoe.

If the player wearing shoes fitted with shimmed traction members walks the golf course being played, the shimming may cause some discomfort after a prolonged period. If so, the player may simply remove the shimmed traction members, separate the traction members from the shims, return such traction members to the bottom of the shoe, and put the shims in his pocket for subsequent use.

The disclosed embodiment is representative of a presently preferred form of the invention, but is intended to be illustrative rather than definitive thereof. The invention is defined in the claims.

I claim:

1. A shoe construction having a bottom and a plurality of ground engageable traction members coupled to and extending beyond said bottom, said bottom having an inside edge and an outside edge, said traction members being of substantially uniform height; and a plurality of shims interposed between said bottom and a corresponding plurality of but less than all of said traction members thereby providing a plurality of shimmed traction members, said shims causing said shimmed traction members to extend beyond said bottom a greater distance than any unshimmed traction member, none of said shimmed traction members being adjacent said inside edge of said bottom.

2. The construction according to claim 1 wherein each of said plurality of shims is of uneven thickness, each of said plurality of shims being thickest at that side thereof which is adjacent the outside edge of said bottom.

3. An attachment for a golf shoe having a bottom from which an array of spaced traction members extend, said bottom having associated with each said traction member a socket for the removable accommodation of a coupling projection carried by each of said traction members, and a shim capable of being interposed between said bottom and a selected one of said traction members, said shim having at one face thereof a socket corresponding to each said socket in said bottom and at an opposite face thereof a coupling projection corresponding to that of each said traction member, said projection of a selected traction member being removed from the corresponding socket of said bottom and the coupling projection of the selected traction member being accommodated in the socket of said shim, said projection of said shim occupying the socket in said bottom from which the projection of said selected traction member has been removed, the arrangement being such that said selected traction member is spaced from said bottom by said shim occupying a position between said bottom and said selected traction member.

4. The attachment according to claim 3 wherein said shim is substantially wedge shaped.

5. The attachment according to claim 3 wherein said shim is substantially uniform in thickness.

6. An attachment for a golf shoe of the kind having a bottom provided with a plurality of threaded sockets removably accommodating threaded projections carried by a plurality of traction members, the threaded projection of any one of said traction members being capable of being accommodated in any one of said sockets, each said traction member including a body having ground engageable projections extending from one side thereof and a coupling projection extending from the opposite side thereof for removable accommodation in a selected socket of said bottom, said attachment comprising a shim having a coupling projection extending from one side of said shim for removable accommodation in any selected one of said sockets in said bottom, said shim having a socket at its opposite side for the removable accommodation of the coupling projection of any selected one of said traction members, any one of said shins being securable in any selected one of said sockets from which a corresponding one of said traction members has been removed, said removed traction member being capable of being secured to the shim which replaced such traction member.

7. The attachment according to claim 6 wherein said shim tapers diametrally from one edge thereof to the opposite edge thereof.

8. The attachment according to claim 6 wherein said projection on said shim extends substantially normal to the adjacent surface of said shim and wherein said socket in said shim extends substantially normal to the other surface of said shim, said surfaces of said shim occupying non-parallel planes.

9. The attachment according to claim 6 wherein said shim tapers longitudinally from one end toward the other.

* * * * *